US012209749B2

(12) United States Patent
Beyer

(10) Patent No.: US 12,209,749 B2
(45) Date of Patent: Jan. 28, 2025

(54) ROOF PLUMBING VENTS AND METHODS INCLUDING FOR TANKLESS WATER HEATERS WITH CONCENTRIC VENTING

(71) Applicant: Aurora Plumbing Company, LLC, Cypress, TX (US)

(72) Inventor: Scott Beyer, Cypress, TX (US)

(73) Assignee: Aurora Plumbing Company, LLC, Cypress, TX (US)

( * ) Notice: Subject to any disclaimer, the term of this patent is extended or adjusted under 35 U.S.C. 154(b) by 294 days.

(21) Appl. No.: 17/579,509

(22) Filed: Jan. 19, 2022

(65) Prior Publication Data

US 2023/0027028 A1 Jan. 26, 2023

Related U.S. Application Data

(60) Provisional application No. 63/233,253, filed on Aug. 14, 2021, provisional application No. 63/225,334, filed on Jul. 23, 2021.

(51) Int. Cl.

| | |
|---|---|
| ***F23J 13/08*** | (2006.01) |
| ***F23J 13/04*** | (2006.01) |
| ***F24H 1/10*** | (2022.01) |

(52) U.S. Cl.

CPC ..... *F23J 13/08* (2013.01); *F23J 2211/101* (2013.01); *F24H 1/107* (2013.01)

(58) Field of Classification Search

CPC . F23L 17/02; F23L 17/10; F23L 17/12; F23L 11/005; F23J 2213/50; F23J 2213/201; F23J 13/08; F23J 13/04; F23J 2211/101; F24B 1/1895; F24H 1/107

See application file for complete search history.

(56) References Cited

U.S. PATENT DOCUMENTS

| | | | | |
|---|---|---|---|---|
| 8,990,291 | B2 | 9/1908 | Brown | |
| 1,129,535 | A * | 2/1915 | Archibald | F24B 1/191 126/319 |
| 2,853,773 | A | 9/1958 | Darasko | |
| 3,232,207 | A * | 2/1966 | Gibbons | F23J 13/08 244/33 |

(Continued)

FOREIGN PATENT DOCUMENTS

| | | | |
|---|---|---|---|
| CH | 205280 | A | 6/1939 |
| CN | 202642564 | U | 1/2013 |

(Continued)

*Primary Examiner* — Steven S Anderson, II

(74) *Attorney, Agent, or Firm* — Quisenberry Law PLLC

(57) ABSTRACT

A vent apparatus is used to install a tankless water heater or similar equipment inside an attic without going onto the roof. The vent apparatus may include a main housing and an umbrella assembly movably disposed therein. The main housing (e.g., PVC pipe) is installed through the roof. The umbrella assembly may have a central rod with a flexible umbrella cover on top and an engagement member on bottom. The umbrella assembly is pushed up through the main housing until the engagement member hits the bottom of the main housing and the umbrella cover exits the top of the main housing to cover it and prevent rain from entering the main housing. The bottom of the main housing is then connected to the tankless water heater. Additional embodiments are disclosed for tankless water heaters with an air intake port and a gas exhaust port.

20 Claims, 6 Drawing Sheets

(56) References Cited

U.S. PATENT DOCUMENTS

| | | | | |
|---|---|---|---|---|
| 4,350,183 | A | 9/1982 | Holmes | |
| 5,520,219 | A | 5/1996 | Hessian | |
| 5,687,773 | A | 11/1997 | Ryan et al. | |
| 5,819,804 | A | 10/1998 | Ferrer | |
| 6,035,898 | A * | 3/2000 | Dominguez | F16L 55/132 138/90 |
| 6,047,739 | A | 4/2000 | Nixon | |
| 6,500,061 | B1 | 12/2002 | Ambrose | |
| 7,013,296 | B1 | 3/2006 | Storey et al. | |
| 9,341,368 | B2 | 5/2016 | Sugatani et al. | |
| 9,896,847 | B2 | 2/2018 | Sugatani | |
| 2006/0081300 | A1 | 4/2006 | Schmalz | |
| 2016/0053995 | A1 | 2/2016 | Sugatani et al. | |
| 2016/0060873 | A1 | 3/2016 | Sugatani | |

FOREIGN PATENT DOCUMENTS

| | | | | |
|---|---|---|---|---|
| CN | 206220377 | U | 6/2017 | |
| CN | 206429346 | U | 8/2017 | |
| CN | 206846177 | U | 5/2018 | |
| CN | 210118582 | U | 2/2020 | |
| CN | 212495908 | U | 2/2021 | |
| EP | 0999417 | A2 | 5/2000 | |
| GB | 2252383 | A | 8/1995 | |
| GB | 2488135 | A * | 8/2012 | F23J 13/08 |

* cited by examiner

FIG.2A
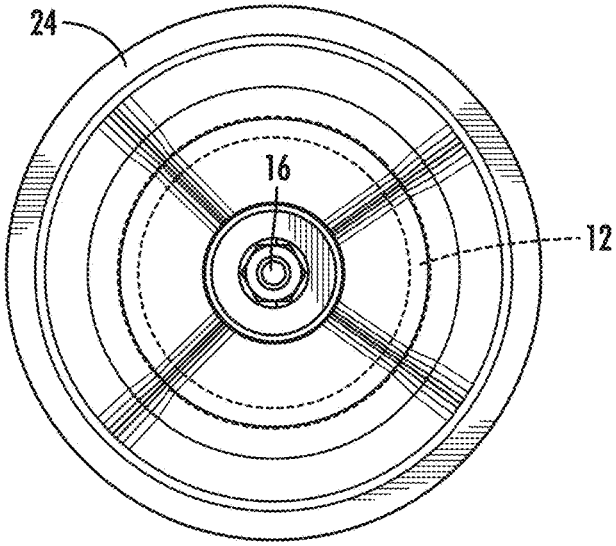
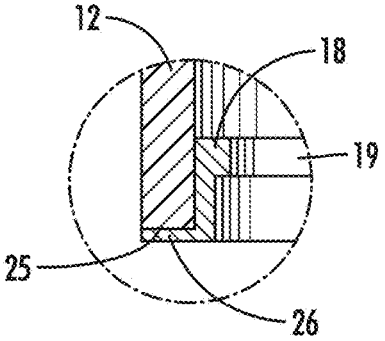
FIG.2C
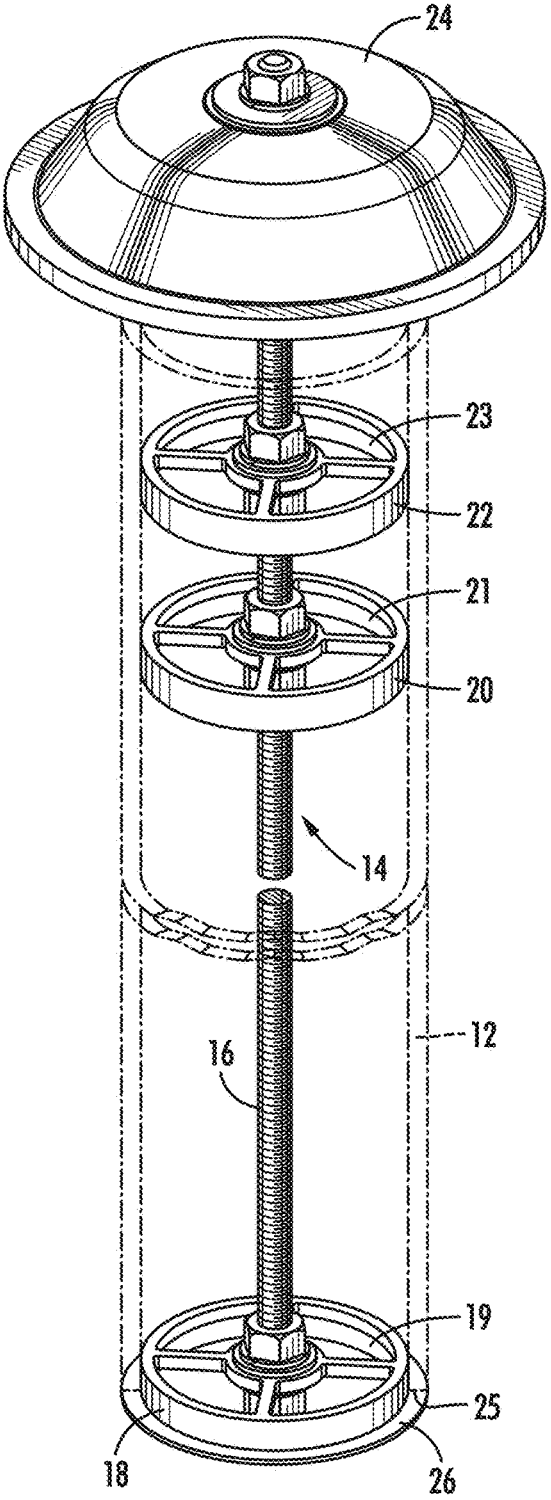
FIG.3

4A
4A
D1
24
30
D2
37
36
25
23'
12
32
38
16
4B
4B
23
22
32
12
35
12
38
38
30
38
30

21
20
32
16
34
34
12
38
40
4C
4C
19
18
25
26
42

30
32
37
36
16
24
35
25
12
32
16
22
34
34
12
38
40
20
D 36
16
42
D 24
18

ROOF PLUMBING VENTS AND METHODS INCLUDING FOR TANKLESS WATER HEATERS WITH CONCENTRIC VENTING

RELATED APPLICATIONS

This application claims the benefit of U.S. Provisional Application No. 63/225,334, filed Jul. 23, 2021, and U.S. Provisional Application No. 63/233,253, filed Aug. 14, 2021, the contents of which provisional patent applications are fully incorporated herein by reference.

BACKGROUND OF THE INVENTIONS

1. Field of the Inventions

The present inventions generally pertain to tankless water heaters or similar equipment, and the plumbing of same up through a roof structure.

2. Description of the Related Art

The present inventions may be used when replacing a traditional tank water heater with a tankless water heater, and also when installing a new tankless water heater. The present inventions may also be used with other types of equipment, such as furnaces, for example. Traditional tank water heaters are plumbed through the roof with a 3-inch metal pipe. Tankless water heaters, however, are plumbed through the roof with 3-inch PVC pipe. This means the existing metal pipe must be removed and replaced with PVC pipe. The problem this creates is the need for a plumber to climb up on the roof and perform additional work on the part of the new PVC pipe sticking up through the roof to prevent water from entering the top of the PVC pipe. This problem also exists when installing a new tankless water heater. This problem persists with respect to tankless water heaters that only require exhaust venting via one outlet, and also for tankless water heaters that are provided with concentric venting (i.e., the tankless water heater has an exhaust outlet that vents to the exterior of the home, and also an inlet that brings in fresh air from outside the home).

As will become apparent from the following descriptions and discussion, the present inventions encompass unique, novel and inventive approaches to overcoming the above-described problem.

SUMMARY OF THE INVENTIONS

In one aspect, the present inventions may include a vent apparatus comprising: a main housing having an upper end and lower end; and an umbrella assembly including a central rod having an upper end and a lower end, a lower member attached proximate the lower end of the central rod, and a flexible upper cover attached proximate the upper end of the central rod, the umbrella assembly having a first position in which the flexible upper cover is disposed within the main housing and a second position in which the flexible upper cover is in a deployed state above the upper end of the main housing, the lower member being adapted for engagement with the lower end of the main housing when the flexible upper cover is its deployed state above the upper end of the main housing. Another feature of this aspect of the present inventions may be that the lower member includes at least one passageway, and the at least one stabilizer member including at least one passageway. Another feature of this aspect of the present inventions may be that the lower member includes a body and a lip disposed around the body, the lip being adapted for engagement with the lower end of the main housing, the lip being engaged with the lower end of the main housing when the flexible upper cover is in its deployed state above the upper end of the main housing. Another feature of this aspect of the present inventions may be that the umbrella assembly may further include at least one stabilizer member secured to the central rod between the flexible upper cover and the lower member. Another feature of this aspect of the present inventions may be that the at least one stabilizer member is adapted for mating engagement with an inner surface of the main housing, the at least one stabilizer member positioning the central rod along a longitudinal axis of the main housing when the at least one stabilizer member is engaged with the inner surface of the main housing. Another feature of this aspect of the present inventions may be that the main housing is adapted to be positioned through a hole in a roof of a building and secured to the roof, the upper end of the main housing being disposed above the roof and the lower end of the main housing being disposed below the roof, the flexible upper cover being in its deployed state above the upper end of the main housing, and the main housing being in communication with an exhaust outlet from a tankless water heater.

In another aspect, the present inventions may include a vent apparatus comprising: a main housing having an upper end and lower end; and an umbrella assembly including a central rod, a lower member, at least one stabilizer member, and a flexible upper cover, the lower member being adapted for engagement with the lower end of the main housing, the at least one stabilizer member being attached to the central rod above the lower member, the flexible upper cover being secured to an upper end of the central rod above the at least one stabilizer member, the lower member including a body and a lip disposed around the body, the lip being adapted for engagement with the lower end of the main housing, the lip being engaged with the lower end of the main housing when the flexible upper cover is in a deployed position above the upper end of the main housing. Another feature of this aspect of the present inventions may be that the umbrella assembly may be adapted for removable engagement with the main housing, the umbrella assembly having a deployed position in which the lip on the lower member is engaged with the lower end of the main housing and the flexible upper cover is in a deployed position above the upper end of the main housing. Another feature of this aspect of the present inventions may be that the lower member may include at least one passageway, and the at least one stabilizer member including at least one passageway. Another feature of this aspect of the present inventions may be that the at least one stabilizer member is adapted for mating engagement with an inner surface of the main housing, the at least one stabilizer member positioning the central rod along a longitudinal axis of the main housing when the at least one stabilizer member is engaged with the inner surface of the main housing. Another feature of this aspect of the present inventions may be that the main housing may be adapted to be positioned through a hole in a roof of a building and secured to the roof, the upper end of the main housing being disposed above the roof and the lower end of the main housing being disposed below the roof, the flexible upper cover being in a deployed position above the upper end of the main housing, and the main housing being in communication with an exhaust outlet from a tankless water heater.

In yet another aspect, the present inventions may include a concentric vent assembly comprising: an outer housing having an inner surface and an intake passageway, the intake passageway extending away from the outer housing and in communication with the inner surface of the outer housing; a main housing having an upper end and lower end, the main housing have a flex cap disposed around the main housing and between the upper end and lower end of the main housing, the main housing being disposed within the outer housing and defining a flow passageway between an outer surface of the main housing and the inner surface of the outer housing, the flow passageway extending from an upper end of the outer housing to the intake passageway; and an umbrella assembly including a central rod, a lower member attached to the central rod, and a flexible upper cover attached to the central rod above the lower member, the lower member being adapted for engagement with the lower end of the main housing, and the umbrella assembly being adapted for slidable engagement within the main housing. Another feature of this aspect of the present inventions may be that the umbrella assembly further includes at least one stabilizer member attached to the central rod between the lower member and the flexible upper cover. Another feature of this aspect of the present inventions may be that the at least one stabilizer member may be adapted for mating engagement with an inner surface of the main housing, the at least one stabilizer member positioning the central rod along a longitudinal axis of the main housing when the at least one stabilizer member is engaged with the inner surface of the main housing. Another feature of this aspect of the present inventions may be that the umbrella assembly may be adapted for removable engagement with the main housing, the umbrella assembly having a deployed position in which the lower member is engaged with the lower end of the main housing and the flexible upper cover is in a deployed position above the upper end of the main housing. Another feature of this aspect of the present inventions may be that the main housing may be moveably disposed within the outer housing, the main housing have a deployed position in which the flex cap is disposed above the upper end of the outer housing. Another feature of this aspect of the present inventions may be that the lower member includes a body and a lip disposed around the body, the lip being adapted for engagement with the lower end of the main housing, the lip being engaged with the lower end of the main housing when the flexible upper cover is in a deployed position above the upper end of the main housing. Another feature of this aspect of the present inventions may be that the lower member may include at least one passageway, and the at least one stabilizer member including at least one passageway. Another feature of this aspect of the present inventions may be that the at least one stabilizer member may be adapted for mating engagement with an inner surface of the main housing, the at least one stabilizer member positioning the central rod along a longitudinal axis of the main housing when the at least one stabilizer member is engaged with the inner surface of the main housing. Another feature of this aspect of the present inventions may be that the outer housing may be adapted to be positioned through a hole in a roof of a building and secured to the roof, an upper end of the outer housing being disposed above the roof and a lower end of the outer housing being disposed below the roof, the flexible upper cover being in a deployed position above the upper end of the main housing, and the flex cap being in a deployed position above the upper end of the outer housing.

Other features, aspects and advantages of the present inventions will become apparent from the following discussion and detailed description.

BRIEF DESCRIPTION OF THE DRAWINGS

FIG. 2A is a top view taken along line 2A-2A of FIG. 2.

FIG. 2C is an enlarged view of section 2C in FIG. 2.

FIG. 3 is a perspective view of the vent apparatus shown in FIGS. 1 and 2 with a main housing thereof shown in dashed lines, and further illustrating an umbrella assembly removably disposed above the main housing.

While the inventions will be described in connection with the preferred embodiments, it will be understood that the scope of protection is not intended to limit the inventions to those embodiments. On the contrary, the scope of protection is intended to cover all alternatives, modifications, and equivalents as may be included within the spirit and scope of the inventions as defined by the appended claims.

DETAILED DESCRIPTION OF THE INVENTION

Figure 1:
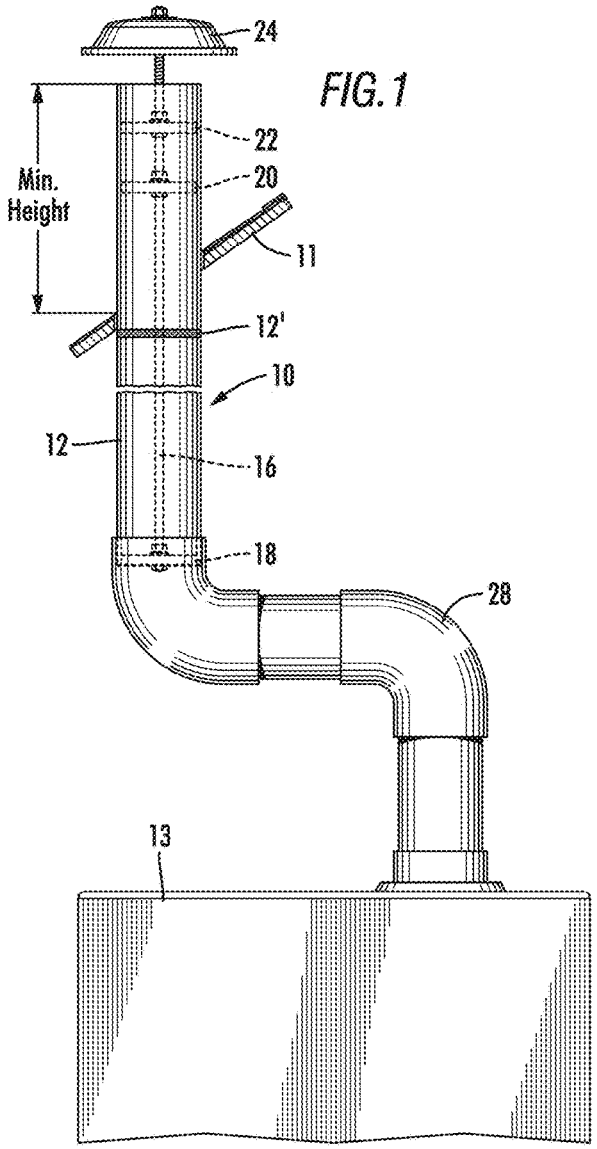
FIG. 1 is a side view of a portion of a tankless water heater installed in an attic with a specific embodiment of a vent apparatus constructed in accordance with the present inventions in communication with the tankless water heater and extending upwardly through a roof.
Figure 2:
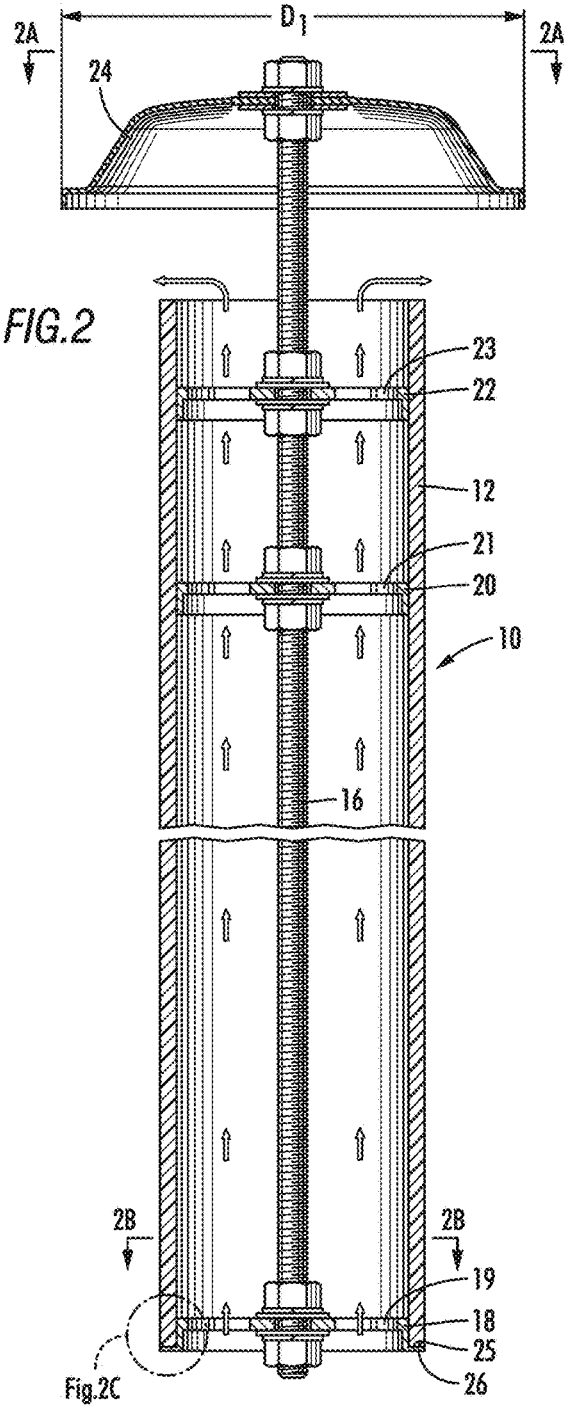
FIG. 2 is side view in partial cross section of the vent apparatus shown in FIG. 1.
Figure 2B:
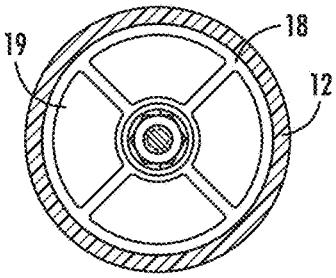
FIG. 2B is a cross-sectional view taken along line 2B-2B of FIG. 2.

Referring to the drawings in detail, wherein like numerals denote identical elements throughout the several views, and referring initially to FIG. 1, there is shown a side view of a vent apparatus 10 extending upwardly through a roof 11 and downwardly in communication with a tankless water heater 13. With reference to FIGS. 1-3, the vent apparatus 10 may include a main housing 12 and an umbrella assembly 14 adapted to be pushed up through the main housing 12. In a specific embodiment, the main housing 12 may be section of PVC pipe, such as a 3-inch diameter PVC pipe.

As best shown in FIG. 3, in a specific embodiment, the umbrella assembly 14 may include a central rod 16, a lower member 18 (such as a disc) attached to a lower end of the rod 16, a first stabilizing member 20 (such as a disc) attached to the rod 16 above the lower member 18, a second stabilizing member 22 (such as a disc) attached to the rod 16 above the first stabilizing member 20, and a flexible upper cover or "umbrella" member 24 attached to an upper end of the rod 16. The flexible cover 24 may be adapted to be collapsible to fit within and be pushed upwardly through the main housing 12 (this is illustrated in FIGS. 5A and 5B in connection with concentric embodiments of the present inventions, discussed below). In a specific embodiment, the first and second stabilizing discs 20 and 22 may fit snugly within the main housing 12, function to locate the rod 16 along a central axis of the main housing 12, and be provided with a plurality of holes 21 and 23 therethrough to allow for venting. In a specific embodiment, the lower member 18 may also be provided with one or more holes 19 for venting. In a specific embodiment, the umbrella assembly 14 may be provided with only one, or none, of the first and second stabilizing members 20 and 22.

In a specific embodiment, to install the above-described embodiment of the present inventions, the existing 3-inch metal pipe extending through the roof is first removed (assuming the inventions are used for a replacement as opposed to a new installation) and replaced with the main housing 12. When the main housing 12 is initially positioned up through the roof 11, the umbrella assembly 14 is in a first position in which the flexible cover 24 is in a compressed state inside the main housing 12. Once the main housing 12 is secured through the roof, the umbrella assembly 14 is pushed upwardly through the main housing 12. In a specific embodiment, the umbrella assembly 14 is pushed upwardly through the main housing 12 until an outer lip 26 around the lower member 18 engages a lower end 25 of the main housing 12, and the flexible cover 24 exits above the main housing 12 and above the roof 11.

As shown in FIG. 1, when the umbrella member 24 exits the top of the main housing 12, it will expand out in the shape shown in FIGS. 1-3 so as to cover the top of the main housing 12 and prevent the entry of water such as rain down inside the main housing 12. In a specific embodiment, the top of the main section 12 preferably extends above the roof by a minimum height "Min. Height" of at least 12 inches. In a specific embodiment, if the main housing 12 is a section of 3-inch diameter PVC pipe, then a diameter D of the umbrella member 24 may be in the range of 5 to 8 inches. As explained elsewhere herein, these dimensions and any other dimensions disclosed herein are not limiting in any way but instead are merely provided as examples. It is important to note that this solution can be implemented entirely within the attic, without the need for the plumber to climb on top of the roof and perform any further work to cover the top of the outer housing 12.

Once the vent apparatus 10 has been installed in place, as shown in FIG. 1, additional PVC piping 28 can be installed as needed to connect the tankless water heater 13 to the main housing 12.

Alternative/Concentric Embodiment

The vent apparatus 10 described above may also be used in connection with another pipe assembly (described below) for use with tankless water heaters having a concentric venting arrangement (i.e., tankless water heaters that have a fresh air inlet and an exhaust outlet). A specific embodiment according to this feature will be described in connection with FIGS. 4, 4A-4E, and 5-7. In a specific embodiment, the central rod 16 may include an additional or third stabilizing member 25.

Figures 4, 4D, 4E:
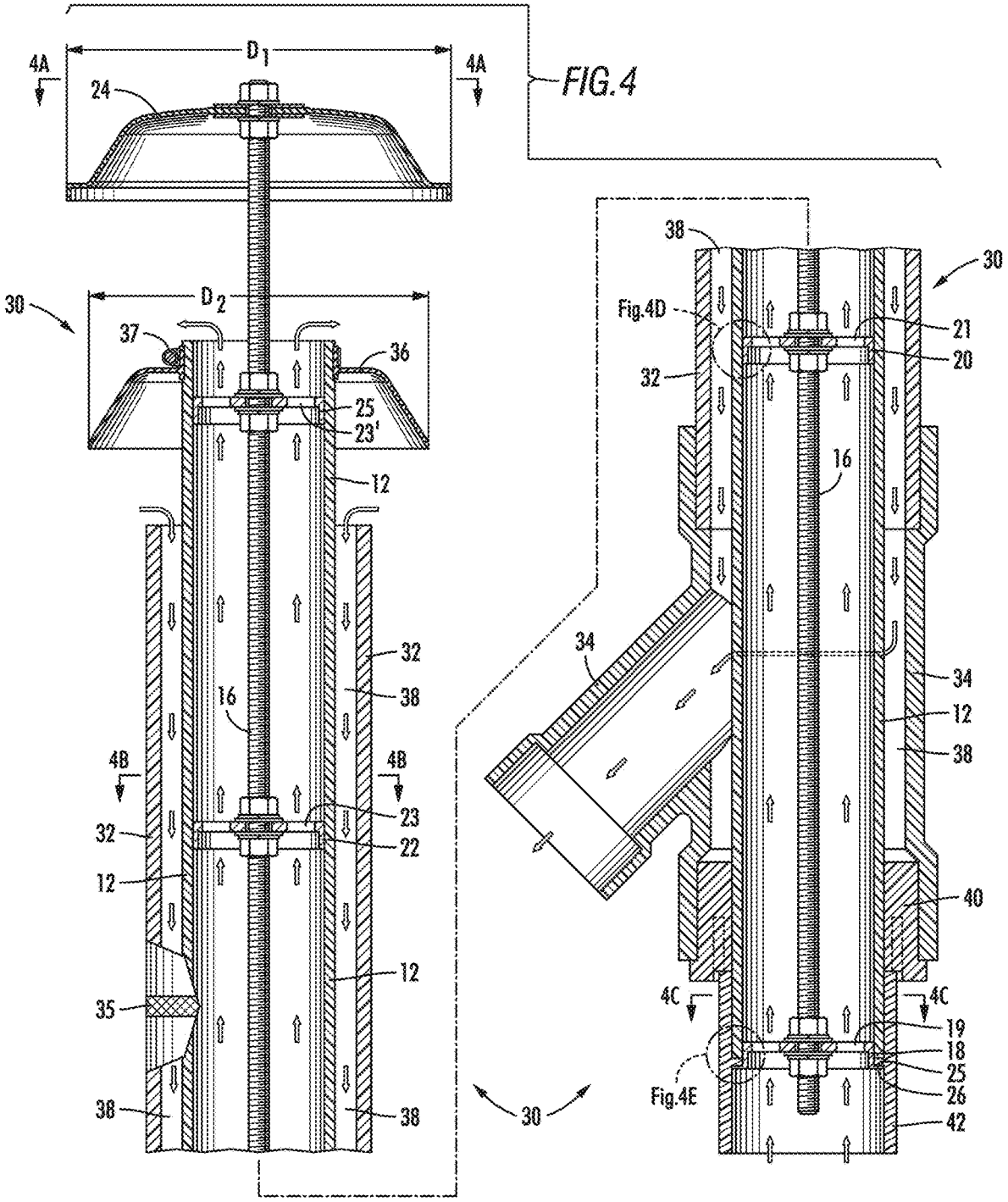
FIG. 4 is a side view in partial cross section of another specific embodiment of a vent assembly, which is adapted for use with a concentric tankless water heater that has an inlet for fresh air from outside a home and an outlet for exhaust gases to be funneled outside the home.
FIG. 4D is an enlarged view of section 4D of FIG. 4.
FIG. 4E is an enlarged view of section 4E of FIG. 4.
Figure 4A:
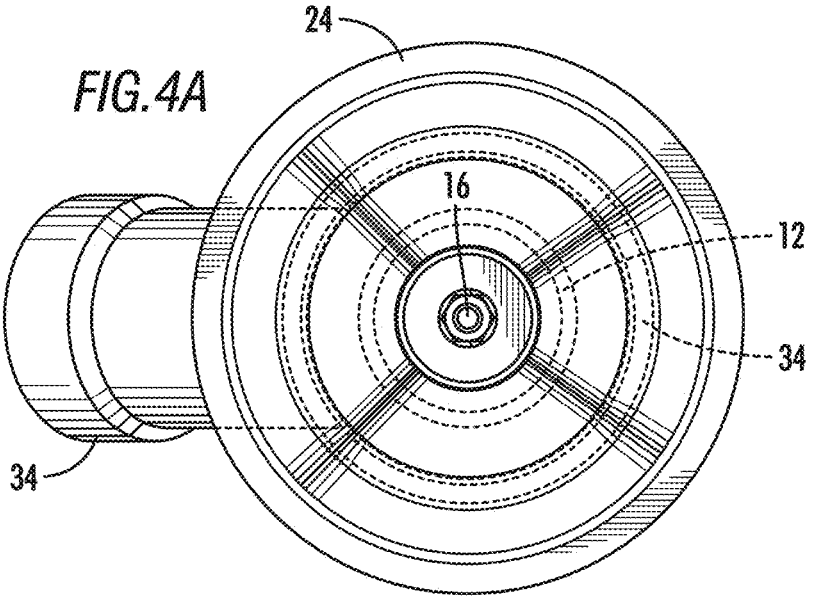
FIG. 4A is a top view of the vent assembly taken along line 4A-4A of FIG. 4.
Figure 4B:
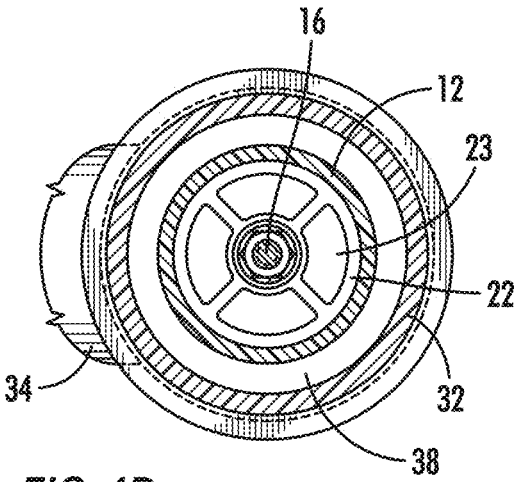
FIG. 4B is a cross-sectional view taken along line 4B-4B of FIG. 4.
Figure 4C:
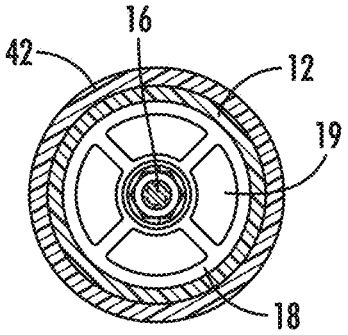
FIG. 4C is a cross-sectional view taken along line 4C-4C of FIG. 4.
Figure 4D:
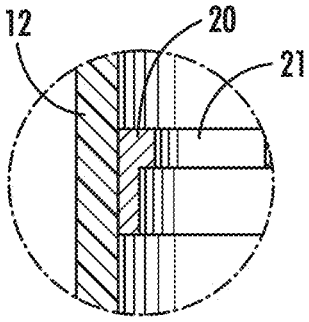
Figure 4E:
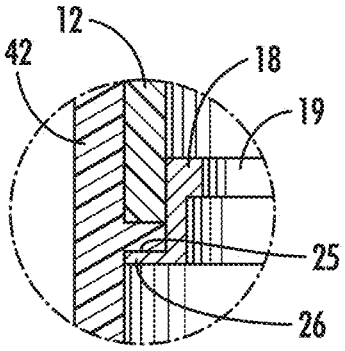

As shown in FIG. 4, a concentric vent assembly 30, which is shown in a fully deployed position in FIG. 4, may include an outer housing 32 having an intake vent pipe 34 that exits a sidewall of the outer housing 32 and that is in communication with an inner bore 33 of the outer housing 32. The intake vent pipe 34 defines an intake passageway to funnel fresh air from above the roof into an inlet port of a tankless water heater or other equipment. In a specific embodiment, the outer housing 32 may be a 3-inch diameter section of PVC pipe. The vent apparatus 10 (e.g., the assembly described above in connection with FIGS. 1-3), modified to include a flex cap 36, discussed below, may be inserted inside the outer housing 32. In a specific embodiment, the flex cap 36 may be secured around the main housing 12 by a connector such as a clamp 37. In a specific embodiment, the clamp 37 may be a stainless steel worm clamp or hose clamp (or other structure that complies with applicable local plumbing/building codes) that wraps around the outside of the main housing 12 and around an upper portion of the flex cap 36 so as to secure the flex cap 36 to the main housing 12. In a specific embodiment, the main housing 12 on the vent apparatus 10 may be a 2-inch diameter PVC pipe. In a specific embodiment, the lower end of the main housing 12 is plumbed to an exhaust pipe exiting a tankless water heater having concentric venting, similar to what is shown in FIG. 1. The exhaust gas flows upwardly as indicated by the arrows inside the main housing 12 and exits the top of the main housing 12 above the flex cap 36 and beneath the flexible cover 24. The concentric vent assembly 30 is shown in FIG. 4 in its deployed position. It also has a first, or undeployed, position as shown in FIG. 5, further discussed below, in which the flex cap 36 is contained within the outer housing 32, the flexible cover 24 is contained within the main housing 12, and the main housing 12 is contained within the outer housing 32.

With reference to FIG. 4, an annular space 38 is defined between the outer housing 32 and the main housing 12. Fresh air from above the roof 11 (see FIGS. 4 and 7) flows into the annular space 38 at the top of the outer housing 32 and down the annular space 38 which acts as a flow passageway as indicated by the arrows and out through the intake vent pipe 34 and into a fresh air intake pipe (not shown) on the concentric tankless water heater or other equipment (also not shown). The annular space 38 adjacent the lower ends of the outer housing 32 and the main housing 12 is sealed by a fitting 40 so as to direct the fresh air through the intake vent pipe 34 as opposed to exiting the bottom of outer housing 32. When the concentric vent assembly 30 is in its positions as shown in FIGS. 5 and 6, the flex cap 36 is disposed and held in the annular space 38.

In a specific embodiment, the concentric vent assembly 30 may include one or more stabilizer members (not shown), which may be attached around the main housing 12, within the outer housing 32, and disposed within the annular space 38. In a specific embodiment, each of these stabilizer members may be provided with one or more passageways or holes (not shown) to allow for flow of fresh air from outside down through the annular space 38. A coupler 42 may be connected at the bottom of the main housing 12 to facilitate plumbing down to the exhaust from the tankless water heater (not shown).

Figure 5:
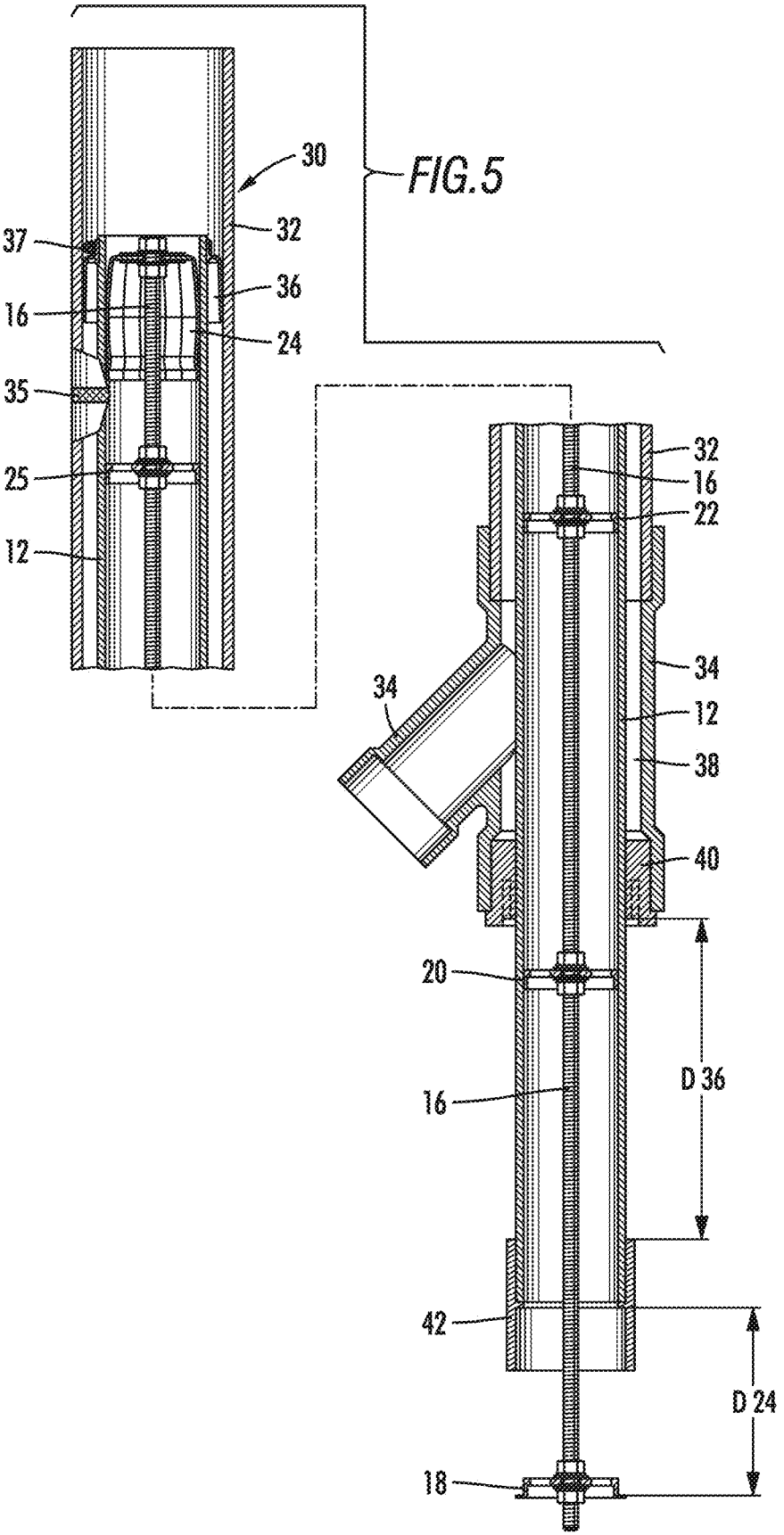
FIG. 5 is a side view in cross-section of a specific embodiment of a concentric vent assembly constructed in accordance with the present inventions and shown in a first or pre-loaded position.
Figure 6:
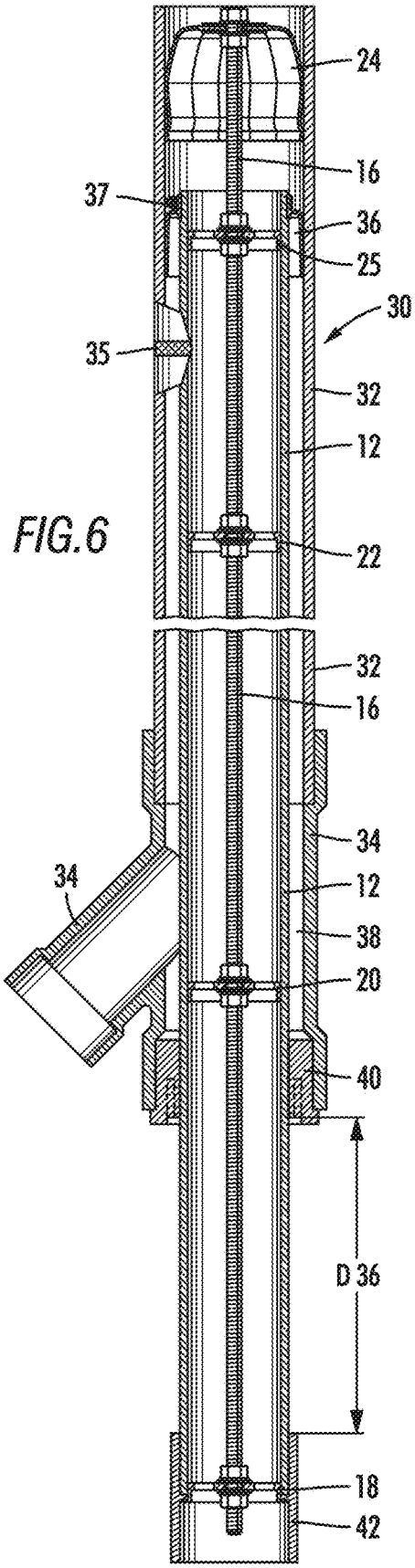
FIG. 6 is a side view in cross-section of the concentric vent assembly shown in FIG. 5 but in a second position.

To install the concentric assembly 30, the old metal pipe is removed from the roof (if being used to replace an old style water heater with a new tankless water heater) and, while the concentric vent assembly 30 is in its first/undeployed position, as shown in FIG. 5, or in its position shown in FIG. 6, the outer housing 32 is inserted through the hole in the roof 11 and secured to the roof 11. In a specific embodiment, a roofline mark 35 may be provided on the outside of the outer housing 35 to align with the lower side of the roof 11. Next, the flexible cover 24 and the flex cap 36 may be moved into their second positions. This can happen in any order. For example, in a specific embodiment, the lower member 18 on the umbrella assembly 14 may be moved a distance D24 from its first position as shown in FIG. 5 to its second position, as shown for example in FIG. 6 or FIG. 4E. In a specific embodiment, the distance D24 may be in the range from 4 to 6 inches. Again, this is a non-limiting dimension provided as just an example. In a specific embodiment, when the lower member 18 is pushed into its second position, then the flexible cover 24 is moved out of the top of the main housing 12. In this second position, in a specific embodiment, the flexible cover 24 may be above the main housing 12 and within the outer housing 32, still in a compressed or collapsed position, as shown at the top of FIG. 6. In another specific embodiment, the flexible cover 24 may be above the main housing 12 and also above the roof 11, as shown in FIG. 7.

Figure 7:
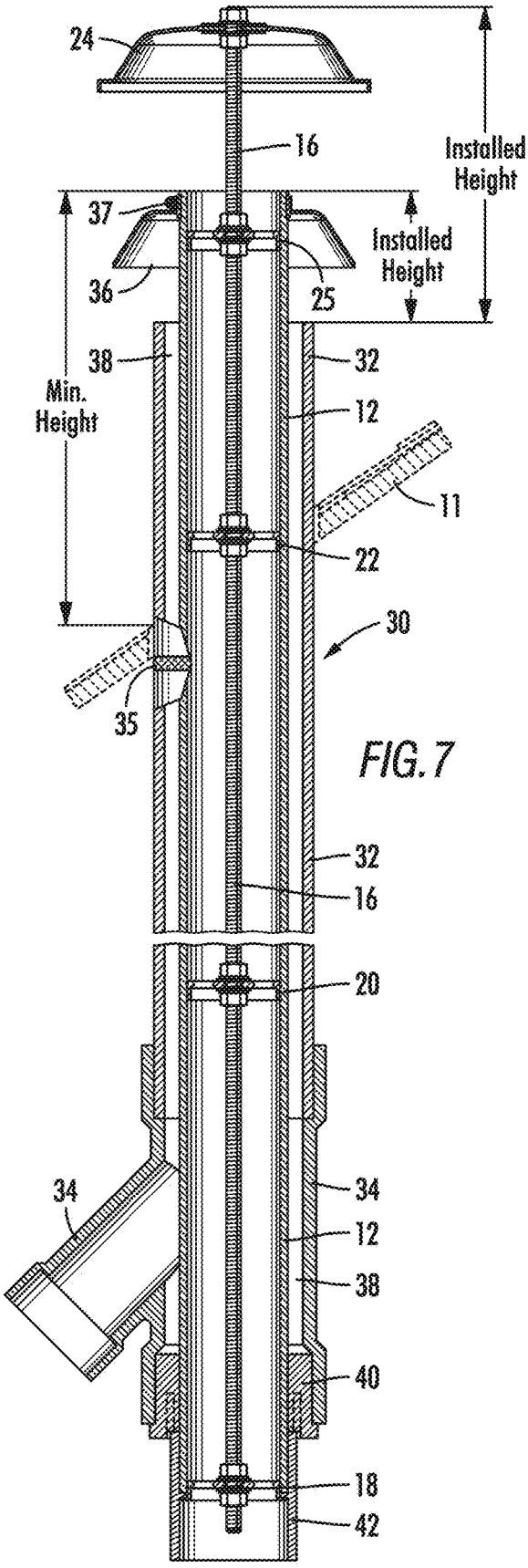
FIG. 7 is a side view in cross-section of the concentric vent assembly shown in FIGS. 5 and 6, but installed through a roof and in a deployed or installed position.

With reference to FIGS. 6 and 7, to move the flex cap 36 into a second position, the main housing 12 is moved upwardly a distance D36 until the top of the coupler 42 engages the bottom of the fitting 40. In a specific embodiment, the distance D36 may be in the range from 6 to 10 inches. In a specific embodiment, movement of the main housing 12 upwardly in this manner will move the flexible cover 24 and the flex cap 36 out of the top of the outer housing 32 and into their deployed positions, as shown in FIG. 7. In these deployed positions, the flex cap 36 functions to keep water from entering the outer housing 32, and also to provide a barrier between fresh air flowing into the annular space 38 and the exhaust gases exiting the top of the main housing 12; and the flexible cover 24 functions to keep water from entering the main housing 12. In a specific embodiment, when in these deployed positions as shown in FIG. 7, the installed height distance IH36 from the top of the outer housing 32 and the top of the main housing 12 may be in the range of 3 to 5 inches; and the installed height distance IH 24 from the top of the outer housing 32 to the top of the central rod 16 may be in the range of 6 to 10 inches. As explained above, this design allows the plumbing installer to install the concentric tankless water heater from the attic, without climbing on to the roof, which results in labor cost savings and enhanced safety.

The present inventions are not limited to any particular sizes or dimensions. While certain dimensions have been provided above as examples for various parts and relationships of various specific embodiments of the present inventions, those should be taken merely as examples and not as limitations on the scope of the inventions.

As noted above, the present inventions may be used in connection with equipment other than tankless water heaters, such as furnaces. For example, if a furnace or other item of equipment has an exhaust temperature sufficiently low that PVC or similar piping can be used to move exhaust gases from the equipment (e.g., a furnace) to the exterior of an enclosed structure, such as through the roof, then the present inventions would be applicable to that situation as well. As such, it should be understood that the present inventions are not intended to be limited to use only with respect to tankless water heaters.

It is to be understood that the inventions disclosed herein are not limited to the exact details of construction, operation, exact materials or embodiments shown and described. Although specific embodiments of the inventions have been described, various modifications, alterations, alternative constructions, and equivalents are also encompassed within the scope of the inventions. Although the present inventions may have been described using a particular series of steps, it should be apparent to those skilled in the art that the scope of the present inventions is not limited to the described series of steps. The specification and drawings are, accordingly, to be regarded in an illustrative rather than a restrictive sense. It will be evident that additions, subtractions, deletions, and other modifications and changes may be made thereunto without departing from the broader spirit and scope of the inventions as set forth in the claims set forth below. Accordingly, the inventions are therefore to be limited only by the scope of the appended claims. None of the claim language should be interpreted pursuant to 35 U.S.C. 112(f) unless the word "means" is recited in any of the claim language, and then only with respect to any recited "means" limitation.

The invention claimed is:

1. A vent apparatus comprising:

a main housing having an upper end and lower end; and an umbrella assembly including a central rod having an upper end and a lower end, a lower member attached proximate the lower end of the central rod, and a flexible upper cover attached proximate the upper end of the central rod, the umbrella assembly having a first position in which the flexible upper cover is disposed within the main housing and a second position in which the flexible upper cover is in a deployed state above the upper end of the main housing, the lower member being adapted for engagement with the lower end of the main housing when the flexible upper cover is its deployed state above the upper end of the main housing.

2. The vent apparatus of claim 1, wherein the lower member includes at least one passageway, and the umbrella assembly further includes at least one stabilizer member including at least one passageway.

3. The vent apparatus of claim 1, wherein the lower member includes a body and a lip disposed around the body, the lip being adapted for engagement with the lower end of the main housing, the lip being engaged with the lower end of the main housing when the flexible upper cover is in its deployed state above the upper end of the main housing.

4. The vent apparatus of claim 1, wherein the umbrella assembly further includes at least one stabilizer member secured to the central rod between the flexible upper cover and the lower member.

5. The vent apparatus of claim 4, wherein the at least one stabilizer member is adapted for mating engagement with an inner surface of the main housing, the at least one stabilizer member positioning the central rod along a longitudinal axis of the main housing when the at least one stabilizer member is engaged with the inner surface of the main housing.

6. The vent apparatus of claim 1, wherein the main housing is adapted to be positioned through a hole in a roof of a building and secured to the roof, the upper end of the main housing being disposed above the roof and the lower end of the main housing being disposed below the roof, the flexible upper cover being in its deployed state above the upper end of the main housing, and the main housing being in communication with an exhaust outlet from a tankless water heater.

7. A vent apparatus comprising:

a main housing having an upper end and lower end; and an umbrella assembly including a central rod, a lower member, at least one stabilizer member, and a flexible upper cover, the lower member being adapted for engagement with the lower end of the main housing, the at least one stabilizer member being attached to the central rod above the lower member, the flexible upper cover being secured to an upper end of the central rod above the at least one stabilizer member, the lower member including a body and a lip disposed around the body, the lip being adapted for engagement with the lower end of the main housing, the lip being engaged with the lower end of the main housing when the flexible upper cover is in a deployed position above the upper end of the main housing.

8. The vent apparatus of claim 7, wherein the umbrella assembly is adapted for removable engagement with the main housing, the umbrella assembly having a deployed position in which the lip on the lower member is engaged with the lower end of the main housing and the flexible upper cover is in a deployed position above the upper end of the main housing.

9. The vent apparatus of claim 7, wherein the lower member includes at least one passageway, and the at least one stabilizer member including at least one passageway.

10. The vent apparatus of claim 7, wherein the at least one stabilizer member is adapted for mating engagement with an inner surface of the main housing, the at least one stabilizer member positioning the central rod along a longitudinal axis of the main housing when the at least one stabilizer member is engaged with the inner surface of the main housing.

11. The vent apparatus of claim 7, wherein the main housing is adapted to be positioned through a hole in a roof of a building and secured to the roof, the upper end of the main housing being disposed above the roof and the lower end of the main housing being disposed below the roof, the flexible upper cover being in a deployed position above the upper end of the main housing, and the main housing being in communication with an exhaust outlet from a tankless water heater.

12. A concentric vent assembly comprising:

an outer housing having an inner surface and an intake passageway, the intake passageway extending away from the outer housing and in communication with the inner surface of the outer housing;

a main housing having an upper end and lower end, the main housing have a flex cap disposed around the main housing and between the upper end and lower end of the main housing, the main housing being disposed within the outer housing and defining a flow passageway between an outer surface of the main housing and the inner surface of the outer housing, the flow passageway extending from an upper end of the outer housing to the intake passageway; and an umbrella assembly including a central rod, a lower member attached to the central rod, and a flexible upper cover attached to the central rod above the lower member, the lower member being adapted for engagement with the lower end of the main housing, and the umbrella assembly being adapted for slidable engagement within the main housing.

13. The concentric vent assembly of claim 12, wherein the umbrella assembly further includes at least one stabilizer member attached to the central rod between the lower member and the flexible upper cover.

14. The concentric vent assembly of claim 13, wherein the at least one stabilizer member is adapted for mating engagement with an inner surface of the main housing, the at least one stabilizer member positioning the central rod along a longitudinal axis of the main housing when the at least one stabilizer member is engaged with the inner surface of the main housing.

15. The concentric vent assembly of claim 12, wherein the umbrella assembly is adapted for removable engagement with the main housing, the umbrella assembly having a deployed position in which the lower member is engaged with the lower end of the main housing and the flexible upper cover is in a deployed position above the upper end of the main housing.

16. The concentric vent assembly of claim 12, wherein the main housing is moveably disposed within the outer housing, the main housing having a deployed position in which the flex cap is disposed above the upper end of the outer housing.

17. The concentric vent assembly of claim 12, wherein the lower member includes a body and a lip disposed around the body, the lip being adapted for engagement with the lower end of the main housing, the lip being engaged with the lower end of the main housing when the flexible upper cover is in a deployed position above the upper end of the main housing.

18. The concentric vent assembly of claim 12, wherein the lower member includes at least one passageway, and the umbrella assembly further includes at least one stabilizer member including at least one passageway.

19. The concentric vent assembly of claim 18, wherein the at least one stabilizer member is adapted for mating engagement with an inner surface of the main housing, the at least one stabilizer member positioning the central rod along a longitudinal axis of the main housing when the at least one stabilizer member is engaged with the inner surface of the main housing.

20. The concentric vent assembly of claim 12, wherein the outer housing is adapted to be positioned through a hole in a roof of a building and secured to the roof, an upper end of the outer housing being disposed above the roof and a lower end of the outer housing being disposed below the roof, the flexible upper cover being in a deployed position above the upper end of the main housing, and the flex cap being in a deployed position above the upper end of the outer housing.

* * * * *